US007036432B2

(12) United States Patent
Casenave et al.

(10) Patent No.: US 7,036,432 B2
(45) Date of Patent: May 2, 2006

(54) EXPLOSIVE ROUND WITH CONTROLLED EXPLOSIVE-FORMED FRAGMENTS

(75) Inventors: Daniel Casenave, Castanet Tolosan (FR); Frederic Teilhol, Villefrance de Lauragais (FR)

(73) Assignee: Etienne Lacroix Tous Artifices S.A., Muret (FR)

( * ) Notice: Subject to any disclaimer, the term of this patent is extended or adjusted under 35 U.S.C. 154(b) by 336 days.

(21) Appl. No.: 10/211,417

(22) Filed: Aug. 1, 2002

(65) Prior Publication Data

US 2005/0045057 A1 Mar. 3, 2005

Related U.S. Application Data

(63) Continuation-in-part of application No. 09/579,577, filed on May 25, 2000, now abandoned.

(51) Int. Cl.
*F42B 12/22* (2006.01)

(52) U.S. Cl. ..... 102/492; 102/495; 102/306

(58) Field of Classification Search ..... 102/492, 102/495, 476, 306
See application file for complete search history.

(56) References Cited

U.S. PATENT DOCUMENTS 3,263,612 A * 8/1966 Throner, Jr. ..... 102/496
3,635,163 A * 1/1972 Philipchuk ..... 102/492
3,913,488 A * 10/1975 Dunetz et al. ..... 102/493
4,043,266 A * 8/1977 Held ..... 102/306
4,175,491 A * 11/1979 Thomanek ..... 102/476
4,711,181 A * 12/1987 Ringel et al. ..... 102/476
5,619,008 A * 4/1997 Chawla et al. ..... 102/310

FOREIGN PATENT DOCUMENTS

EP 0150241 * 8/1985
FR 1092563 * 4/1955
FR 1432578 * 2/1966
FR 2588950 * 4/1987
GB 2250572 A * 9/1990

OTHER PUBLICATIONS

Leeming, The Application of an Innovative Grenade Warhead to Defeat Combat Body Armour, NDIA 1999 Internation Infantry & Small Arms Section Symposium.*
Proceedings of the Sixth Symposium on Hypervelocity Impact, Cleveland Ohio, vol. I, 1963.*

* cited by examiner

*Primary Examiner*—M. Clement
(74) *Attorney, Agent, or Firm*—Blakely Sokoloff Taylor & Zafman

(57) ABSTRACT

The invention provides an explosive round that produces fragments propelled by jetting effect, the round consisting in a firing head, an explosive charge, a fragment generating wall in direct contact with the explosive, which wall has a set of indentations extending towards the inside of the round and into the explosive, so that each indentation constitutes a shaped charge, wherein the indentations of the fragment-generating portion are in the form of caps extending inside the explosive, each cap presenting a surrounding base having a diameter comprised between 2.5 mm and 5.5 mm and a wall thickness comprised between 0.5 mm and 0.8 mm, so that each cap generates a corresponding fragment propelled by jetting effect, fragment which has no effectiveness beyond 35 m from the point of explosion.

15 Claims, 4 Drawing Sheets

FIG. 3
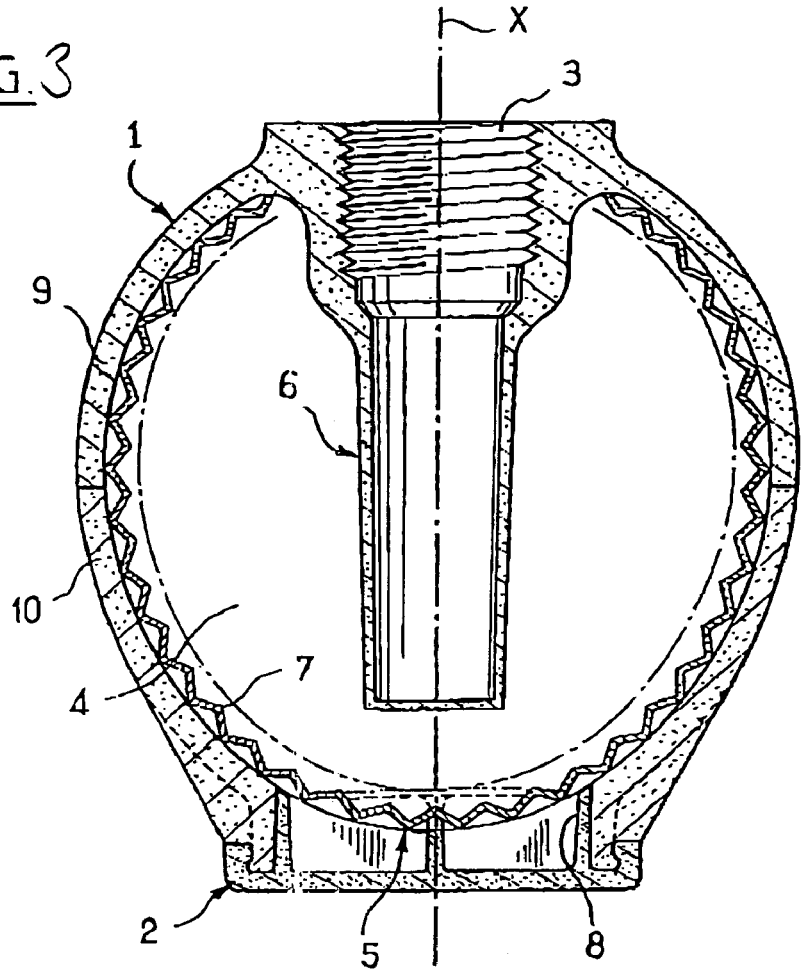
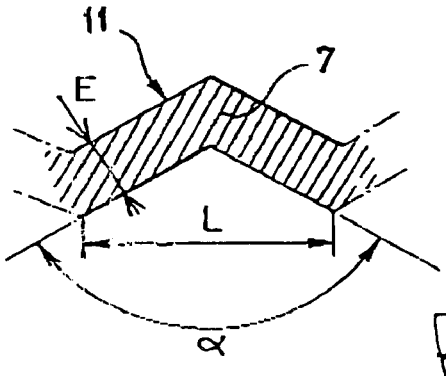
Figure 4

EXPLOSIVE ROUND WITH CONTROLLED EXPLOSIVE-FORMED FRAGMENTS

This is a CIP of Ser. No. 09/579,577 filed on May 25, 2000 now abandoned.

The invention relates to explosive rounds or grenades and in particular to explosive rounds which guarantee a constant size of the propelled fragments.

Apart from high effectiveness in the target, another typical goal in the domain of explosive rounds is to ensure that the fragments are not propelled too far from the point of explosion, and so doing to ensure that the person who sends the round is protected from the fragments propelled by its own explosive round.

It has been determined that the rounds which sometimes propel fragments beyond 35 m, ie dangerous fragments for the sender of the round, are those rounds which have an unreliable Fragmentation.

In other words, the long distance fragments are those which are too heavy due to the fact that the metal wall of the round may not be properly fragmented, ie fragmented into constant and small pieces.

Then for the purpose of ensuring a reliable fragmentation of the external wall of the round, a particular type of round makes use of what it is called "shaped charges" or "jetting effect".

The simple idea is that an explosive bordered by a V-shaped metal wall (ie a hollow charge) transforms into a very thin metal blade followed by a high energy exploding jet.

As illustrated on FIGS. 1 and 2, while consuming from the inside 1 of the ammunition towards the target 20, the jet 40 propels the core metal blade at a speed which is higher than the consuming speed of the explosive.

Using this particularly strong cutting effect, hollow charges have been proposed in explosive rounds for cutting an additional external wall (DE 28 07 309).

In that approach, the external wall is systematically cut along the V-section slots, and thus generates a constant dimension of fragments with reliably limited range.

However double wall round appear to have other disadvantages, such as cost and weight.

Another type of round makes use of shaped or hollow charges with no additional wall such as the round of U.S. Pat. No. 3,635,163.

In this document, the hollow charges are conformed into slots surrounding the round, so that the cutting metal blades are propelled all around the point of explosion.

The hollow slots can be slightly derived from the horizontal plane or disposed in a helicoidal path in order to improve repartition of the jetting effect.

A free hollow-charges wall is thus used for striking the target directly and not for a precise cut of an additional wall.

However, in such embodiment, the free hollow slots appear to have the same dangers as traditional fragment-generating walls, i.e. appear to generate unwished heavy fragments with too high ranges of effectiveness.

The aim of the prevent invention is an explosive round with a free shaped-charges wall; a wall whish forms itself the shaped charges and the propelled fragments, which round provides reliable fragmentation, ie constant size fragments and thus security for the user of the round.

This aim is achieved by an explosive round that produces fragments propelled by jetting effect, the round consisting in a firing head, an explosive charge, a fragment generating wall in direct contact with the explosive, which wall has a set of indentations extending towards the inside of the round and into the explosive, so that each indentation constitutes a shaped charge, wherein the indentations of the fragment-generating portion are in the form of caps extending inside the explosive, each cap presenting a surrounding base having a diameter comprised between 2.5 mm and 5.5 mm and a wall thickness comprised between 0.5 mm and 0.8 mm, so that each cap generates a corresponding fragment propelled by jetting effect, fragment which has no effectiveness beyond 35 m from the point of explosion.

BACKGROUND OF THE INVENTION

Other aspects, object's, and advantages of the present invention will appear on reading the following detailed description of preferred embodiments thereof, given as non-limiting examples and made with reference to the accompanying drawings, in which:

FIG. 3 is a longitudinal section through a hand grenade body in accordance with the present invention;

FIG. 4 is a section view through a Portion of the fragmenting wall of the present invention, in a section plane that is substantially perpendicular to the wall;

Figure 2:
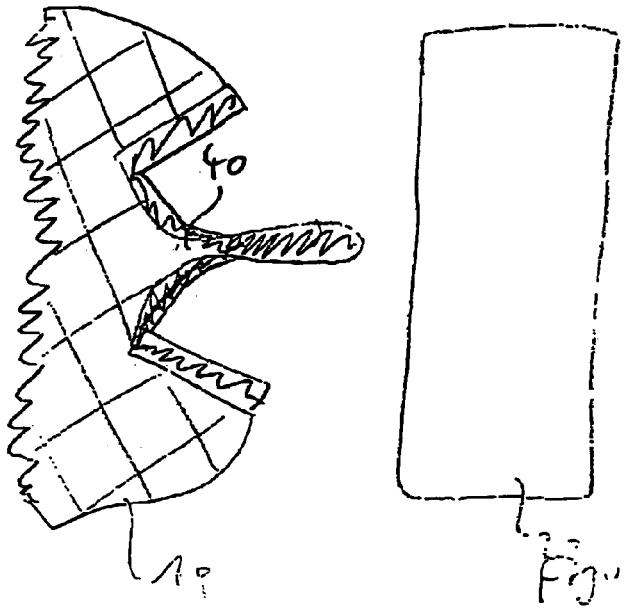
Figure 5:
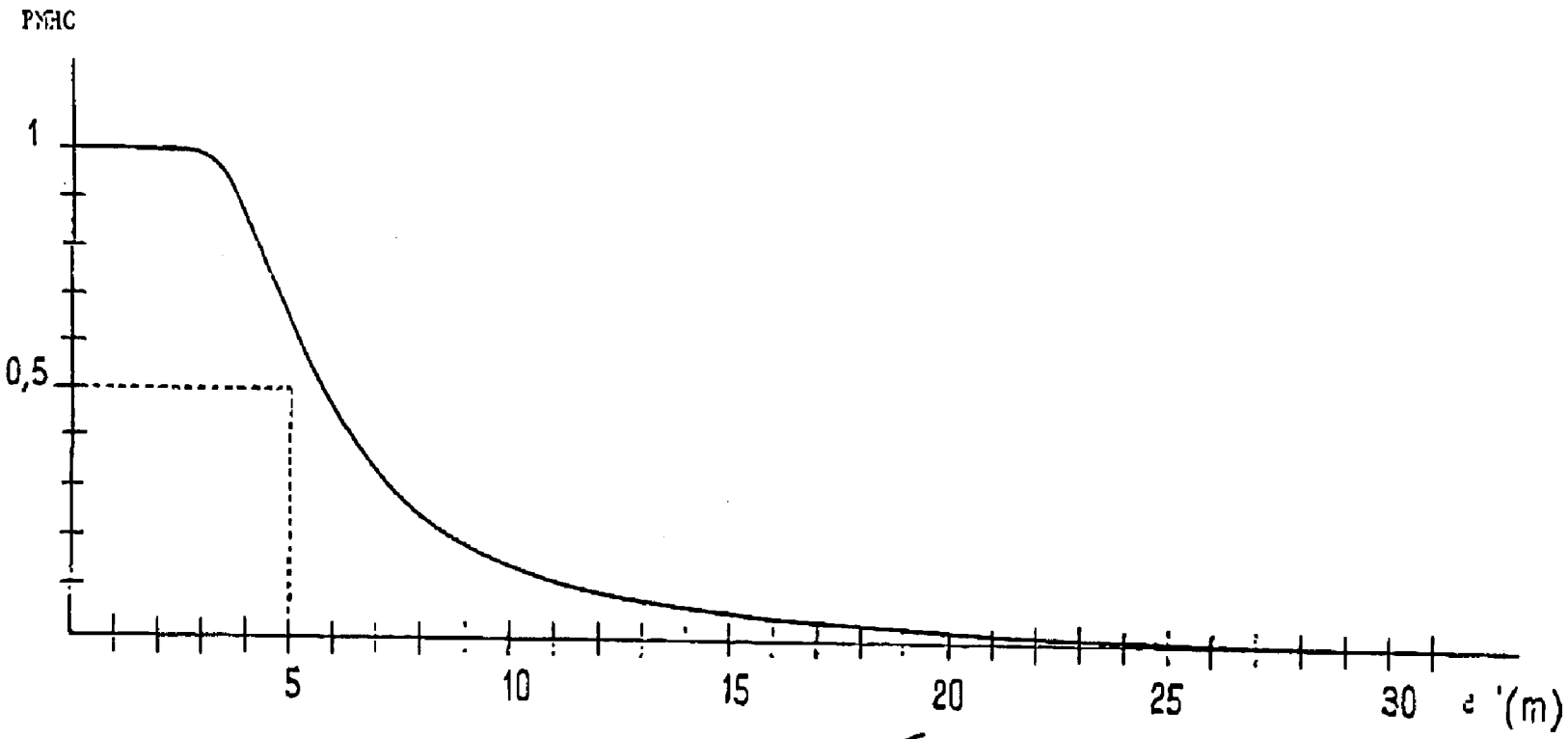
Figure 6:
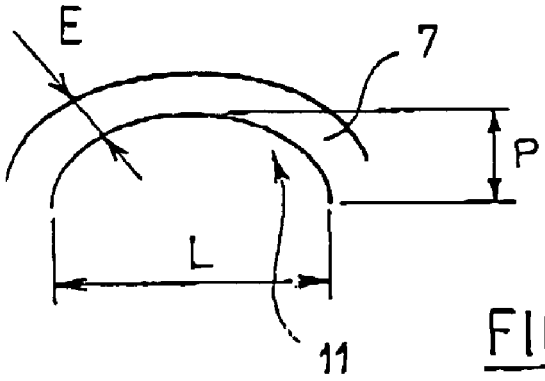
Figure 7:
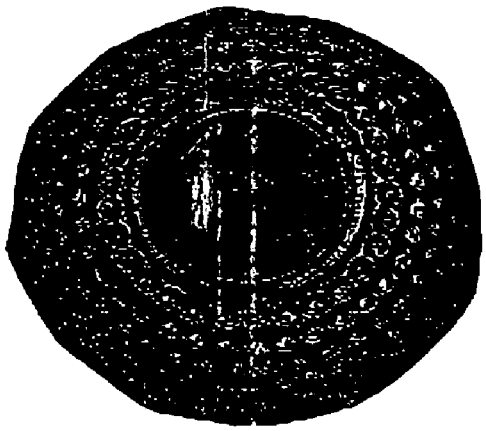

FIG. 5 is a graph showing how the effectiveness in a target of a grenade of the present invention varies as a function of distance measured between the target and the point at which the grenade explodes FIG. 6 is a section view similar to FIG. 2 showing a variant embodiment based on an indentation whose shape is spherical rather that being conical; and FIG. 7 represents a fragment-generating wall of the "gulf ball" type, according to the invention.

MORE DETAILED DESCRIPTION

Figure 1:
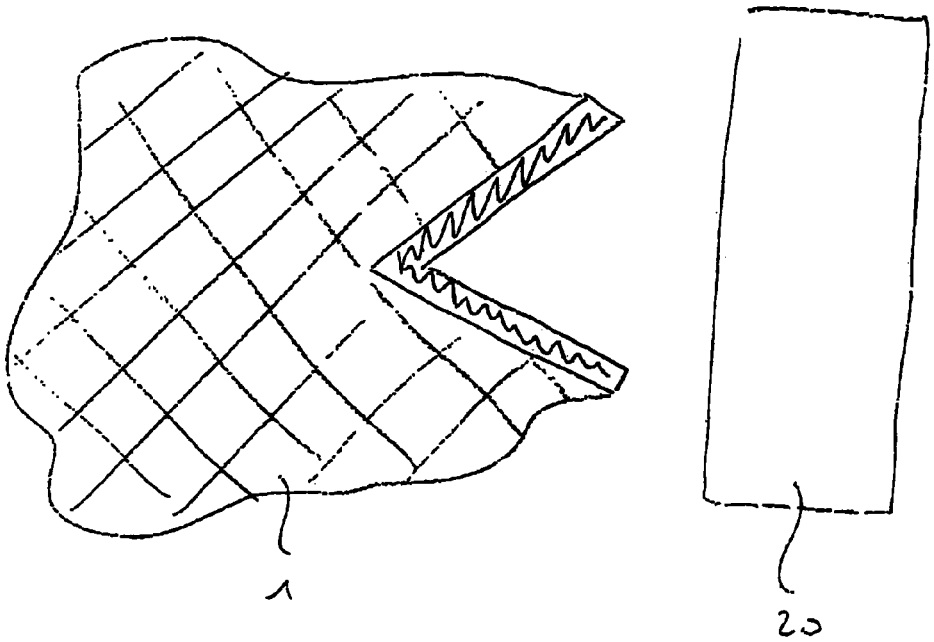
FIGS. 1 and 2 are cross sections of a typical hollow charge as used for piercing the structure of a vehicule, into a successive explosive steps

FIG. 1 shows a hand grenade body comprising a case 7 for generating fragments formed by an explosive, and an explosive charge 4. This grenade body also has a cavity suitable for receiving a detonator or priming plug.

The priming plug is not shown in FIG. 1. In the invention it is possible to use any type of conventional priming plug, suitable for initiating a charge of 90 grams (g) of an explosive such as TNT. A conventional initiator having a charge of 1.5 g to 2 g of PETN is, for example, entirely suitable for initiating the the grenade body described below.

The grenade body of FIG. 1 is generally egg-shaped, being slightly elongate along a vertical axis X.

The grenade body has two opposite ends each forming a flat perpendicular to the axis X. A bottom flat forms a base enabling the grenade to be stood in a vertical position, and a top flat is adapted to receive the priming plug.

The center of the top flat thus has a threaded orifice 3 constituting the inlet to the above-mentioned cavity, and adapted to receive a portion of a priming plug inside the body of the grenade.

This cavity forms a passage which extends inside the grenade parallel to the axis X over a length that is substantially equal to three-fourths of the height of the grenade.

The grenade body is made up of three main elements, namely, a supporting and protective case 1 of plastics material, a fragment-generating metal case 7, and an explosive charge 4.

The case 1 surrounds the entire body of the grenade. It is constituted in this example by acrylonitrile butadiene styrene (ABS). Advantageously, its thickness lies in the range 2 mm to 3.4 mm.

The plastics case 1 is made up of three parts, a top half-shell 9, a bottom half-shell 10, and a plug 2.

The first part 9 is substantially in the form of a hemispherical wall, constituting the top half-shell of the case 1. The wall forming this hemisphere has the orifice 3 forming the entrance for receiving the priming plug in its center. Thus, the orifice 3 opens out into a cylindrical sleeve integrally molded with the hemisphere 9, and extending inside the hemisphere 9, thereby constituting a passage for receiving the priming plug. This cylindrical sleeve 6 is circularly symmetrical about the same axis X as the hemisphere 9.

This first half-shell 9 is fixed on the second half-shell 10 which likewise has a central orifice 8. This orifices 8 has engaged and snap-fastened therein the plastics material plug 2 that forms the bottom stand of the grenade body.

The plug 2 has a concave top face 5 adapted to extend the second half-shell 10 internally in continuous manner. When the first half-shell 9, the second half-shell 10, and the plug 2 are assembled together, the grenade thus presents an inside surface which is egg-shaped and continuous, presenting no discontinuities other than where it comes into contact with the sleeve 6. In accordance with the invention, this concave and egg-shaped inside surface is covered inside the body of the grenade by a metal case 7 for generating fragments.

Thus, the metal case 7 forms an egg-shaped wall which surrounds the inside volume of the grenade body almost completely. The metal case 7 is thus in the form of an egg shell in which a top opening has been formed.

This top opening has the sleeve 6 passing therethrough and it presents a periphery which is complementary to the outline of the sleeve 6.

In the embodiment described herein, the metal case 7 is made up of two portions assembled together so as to form a continuous surface. A first one of these two portions covers the entire concave top surface of the plug 2, and is restricted thereto.

A second portion covers the remainder of the egg-shaped inside surface of the plastics case 1, i.e. the egg-shaped inside surface formed by the top and bottom half-shells.

These two metal portions are placed edge to edge and between them they cover the entire inside surface of the plastics case 1.

In an embodiment of the invention, the case 7 is fixed inside the plastics case by the case being fitted around it.

The wall covering the plug 2 is secured to the plug such that when the plug is removed from the remainder of the plastics body 1, the metal wall covering the plug is likewise removed. The grenade body can thus be filled with an explosive substances through its bottom orifice when it has been opened in this way.

In a variant of the invention, the case 7 comprises two complementary half-shells inside each of the two half-shells of the plastics case 1. This disposition makes the grenade body easy to assemble. Each half-shell of the plastics case is initially lined internally with one of the two metal half-shells, such that two metal-and-plastics half-shells are obtained. These two metal-and-plastics half-shells are then assembled together, edge to edge.

In accordance with the invention, the wall 7 is made up of a multitude of cavities or indentations of small size formed by the metal wall 7. Each of these cavities has a concave shape facing the inside of the grenade. More precisely, and as can be seen in FIG. 1, these concave shapes are constituted by respective cones whose tips point towards the inside of the grenade.

At all points, the wall 7 is of constant thickness, regardless of whether the point is at the tip or the base of an indentation.

Each cone or indentation has a base conventionally defined as being an outline belonging to the cone and whose diameter or width is at a maximum, said width being measured tangentially to the case 7.

Each cone or indentation is rigidly united to the adjacent cones or indentations via the outline formed by its base.

In the embodiment described herein, the only gap within the wall 7 corresponds to a circular gap between the wall covering the plug 2 and the wall covering the remainder of the inside surface of the plastics body.

These two wall of the case 7 can be made in their final shape directly by melding, or else they can be shaped by stamping. In the embodiment described herein, the wall 7 forms approximately 800 cones or indentations pointing towards the inside of the grenade.

The grenade is filled with an explosive substance occupying the space left available therefor between the metal case 7 and the outline of the sleeve 6. The explosive substance comes directly into contact with the metal case 7 such that the case 7 is sandwiched between the explosive substance 4 and the plastics case 1.

Because of the particularly small thickness of the wall constituting the case 7, the case made of plastics material serves not only to ensure that the grenade body is leakproof, but also to provide mechanical support for the metal case 7, for the priming plug inside the metal case 7, and to protect the metal case 7 against impacts.

There follows a description of the particular shockwave effect that is obtained in the vicinity of the inside points 11 obtained in the context of the present invention.

In conventional manner, when explosion of the grenade is initiated, a shockwave propagates from the priming plug, i.e. from inside the sleeve 6, and away therefrom towards the outside of the grenade.

The shockwave thus reaches the metal case while propagating in a direction that is perpendicular thereto, such that the wavefront of the shockwave extends locally parallel to the metal wall.

The inventors have discovered that for particular sizes of indentations 11 defining the explosive charge, each indentation gives rise to a charge/case combination that provides a miniature shaped charge of the hollow charge type or preferably of the explosive-formed projectile type.

Thus, with the present grenade, each indentation deforms under the effect of the shockwave to produce a microprojectile of compressed material that is compressed from the outside of the indentation, that is elongate in shape, and that; travels along an axis that is substantially radial relative to the grenade.

This microprojectile turns out to be particularly effective at short range.

In addition, the microprojectile is propelled in a direction that is precise, being defined by the main direction of the indentation 11, such that the direction of the microprojectile is fully under control.

In addition, the shaped charge microprojectile does not give rise to unwanted effect beyond a selected safe range. The energy delivered by the miniature shaped charges lies essentially in the very high propagation speed of the microprojectile, rather than in the inertial of the microprojectile mass which is very small. As a result, this energy is dissipated very quickly as the microprojectile moves away from the point of explosion, contrary to conventional grenades which deliver energy that is produced essentially by propelling heavy fragments at speeds that are low compared with those obtained in this case using the shaped charge effect. Thus, the explosive-formed fragments generated by prior art grenades retain high kinetic energy because of their initial over ranges that are much longer, whereas the fragments formed by explosive as generated in the present invention are very lightweight and very fast, such that their kinetic energy which is initially very high due to the shaped charge effect drops off very quickly because of their small mass.

By using such miniature shaped charges, i.e. with particularly low wall thickness and base width in such a grenade, the short range effect is decorrelated from the long range effect because the miniature shaped charge is found to suffer from a sudden decrease in effectiveness as a function of range from the point of explosion.

It should be observed that the most useful portion of the explosive for forming and propelling the microprojectile is the portion around the cone. The central portion of the explosive can thus be modified without giving rise to overall modification in the behavior of the round, providing no significant modification is made to the shape of the detonation wave or to the ability of the explosive mass to transmit the detonation wave to the zones surrounding the indentations 11.

When the indentations 11 are subjected to the shockwave, they separate from one another, and thus each of them behaves like an independent impact. The mass of the projectiles is thus accurately predetermined and the dynamic behavior thereof is under control.

The inventors have also found that with miniature cones or caps, the projectiles result from these shapes or indentations produce no effect in a target beyond a 30–35 range around the point of explosion, while nevertheless keeping a large effect at shorter range from the point of explosion.

A fact that the hollow charges or miniature in thickness and width allows the sudden drop of the energy of the projectiles, and provides a grenade whose short range and long range effects are highly decorrelated.

Thus, the indentation of FIG. 3, shown in section on a plane perpendicular to the wall 7 and passing through the tip of an indentation, has three main dimensional parameters, namely indentation width as measured at its base, the angle at which the indentation opens, and the thickness of the wall constituting the indentation.

The opening angle, i.e. the angle measured between two generator lines of the indentation, is referenced a in FIG. 4.

The width at the base of the indentation, as measured tangentially to a mean surface of the case 7, is referenced L.

The thickness of the conical wail is referenced E.

Thus, the inventors have been able to demonstrate the desired effect i.e. the combination:

firstly: high effectiveness in a target at a range of about 5 meters (m) and secondly: a safe rankle of about 25 m;

is obtained particularly when the cones are of a width L at the base lying in the range 2.5 mm to 5.5 mm, constituted by a wall whose thickness lies in the range 0.5 mm to 0.8 mm.

Advantageously, the indentations are made of copper and the opening angle $\alpha$ lies in the range 90° to 140°.

In a variant of the invention, the indentations can be replaced by pyramids while still retaining the shaped charge effect, or more generally they can be replaced by concave wall portions each of which forms an indentation whose tip points towards the inside of the grenade.

As with a cone, there can be observed on an indentation-forming concave wall, a wall thickness E, an opening angle $\alpha$, and a base width L.

With pyramids, and more generally with concave walls forming indentations, the inventors have been found that the parameters $\alpha$ and L can be matched to guarantee that the fragments formed by the explosive are no longer effective beyond a range of 25 m.

More precisely, the inventors have found that for equal values of $\alpha$, L, and E, the effectiveness at 5 m and the safe radius are of the same order for cones and for pyramids, although there is an increase in effectiveness in a target with pyramids.

Because of their very small mass, the fragments formed by explosive, or "impacts" have an initial speed that is very high and they are subjected to very high energy loss during their trajectory, such that the effectiveness of the grenade is particularly high at 5 m and practically non-existent beyond a range of 25 m.

It can be seen that the maximum energy of the fragments is conserved to a distance which is equal to about 1000 times the width of the indentation, i.e. about 3 meters in the embodiment described herein.

In the preferred embodiment described herein, the material constituting the wall 7 is standard annealed copper. Naturally, the invention is not limited to a wall for explosive-formed fragments made of copper. Any wall of any material of density and ductility close to those of copper can be adopted with dimensions close to those mentioned above so as to obtain the above-described combination of results.

The invention thus presides for replacing copper by aluminum, where aluminum has the advantage of being less expensive than copper, but is lighter in weight, thereby reducing the range of the fragments.

The proposed values for thickness and width are adopted for copper, but also for the usual types of metals used in fragment generating walls. The same is exact for parameter $\alpha$.

In the particular example of FIGS. 3 and 4, the width of the base L is 3 mm, the opening angle $\alpha$ is 120°, and the wall thickness E is 0.5 mm. Such an indentation has a height or depth of about 1 mm.

Thus, the inventors have found that by increasing the width L, explosive-formed fragments are obtained that have higher energy, giving them greater range, but the density of associated microprojectiles and cores is smaller within the burst since the number of fragments formed by the explosive is itself smaller.

With a grenade having the same shown in FIG. 1, an indentation diameter or width L equal to 3 mm corresponds to the number of indentations being substantially equal to 800 over the entire grenade or to 13 cones per $cm^2$ of the metal case. A value of L equal to 4 mm corresponds to having about 550 indentations at 7 indentations per $cm^2$. A diameter L equal to about 5 mm corresponds to about 350 indentations at 5 indentations per $cm^2$.

The inventors have also found that the angle $\alpha$ has an impact of the obtained jetting effect. The smaller the opening angle $\alpha$, the greater the energy of the microprojectile/core combination. In addition, a smaller opening angle has the effect of reducing the effective range of the fragments produced by explosive.

Under the effect of the explosion, the plastics case does not generate any fragments suitable for influencing effectiveness in the target. It therefore serves merely to hold together the structure of the grenade and to protect it against impacts.

The material constituting the second wall 1 is selected to be flexible enough to avoid attenuating the energy given off by the shaped charges while being sufficiently firm to protect the fragment-generating wall 7 against impact during transport of the ammunition.

In the preferred embodiment described herein, an explosive charge is used that comprises 90 grams of cast hexolite made up of 60% RDX and 40% TNT. Although the hexolite is used in this example by casting, it would also be possible to use a compressed explosive charge.

Tests have also been performed on an explosive charge constituted mainly by 98.2 hexowax or D type TNT in flakes or TDP.

Hexowax is a mixture of 98% RDX and 2% wax that favors compression.

D type TNT is a type of TNT whose melting temperature is particularly high, and it is one of the purest TNTs.

When a mass of about 90 grams of these explosive substances is used, they are found to be particularly well adapted to the shape of hand grenade described with reference to FIGS. 1 and 2. It is also possible to use composite explosives with attenuated sensitivity to risks. The performance of such explosives has been found to be satisfactory in testing.

FIG. 5 is a graph to which a plot shows the effectiveness of the resulting explosive-formed fragment burst as a function of range between the point of explosion of the grenade and the target, for the grenade as shown in FIGS. 3 and 4.

The range d is plotted in meters as measured between the point of explosion of the grenade and a target. A measure of the (effectiveness of the grenade in the vicinity of the explosion is plotted up the ordinate, with said measure being referenced PMHC in FIG. 3.

Maximum effectiveness and zero effectiveness of the grenade correspond respectively to PMHC values of 1 and of 0. This PMHC parameter is calculated in conventional manner on the basis of the number of perforations observed in an aluminum target of fixed area placed at a distance d from the point of the explosion and facing the explosion point.

More precisely, the target is made up of three sheets of aluminum each having an area of 0.476 $m^2$ and placed one against another. The three sheets have respective thicknesses of: 1.5 mm, 1.0 mm, and 1.5 mm, and they are placed so that the 1.0 mm thick sheet is sandwiched between the taco 0.5 mm thick sheets with a test space between sheets having a thickness of 1 cm. The target is placed at distance d from the round. After the explosion, the number of perforations are counted in each of the throve sheets for providing PMHC at each distance.

N1 is the density of fragments that pass through one sheet, N2 is the density of fragments that pass rough two sheets, and N3 is the density of fragments that pass through all three sheets. These densities are calculated by counting the number of perforating fragments relative to the area of 0.476 $m^2$. At distance d, PMHC is calculated using the following equation:

$$PMHC=1-(0.57^{N1}\times 0.20^{N2}\times 0.02^{N3})$$

The curve in FIG. 5 shows that the grenade of FIGS. 1 and 2 is of satisfactory effectiveness for a range of 0 to 6 meters, and that no high energy fragment was present being beyond 25 meters.

The inventors have placed a film of plastic at 25 meters from the explosive point of the grenade shown in FIGS. 1 and 2. This film presented hardly any perforations after the explosion, thus confirming the reliability of the safe range of 25 m. This test shows that the grenade is particularly safe in use.

More generally, the invention provides an explosive round guaranteeing PMHC that is zero beyond a safe range of less than 35 m or 40 m.

The inventors have also observed that a grenade of the invention generates a burst of explosive-formed fragments that are distributed angularly in particularly uniform manner around the explosion point.

A grenade of the invention makes it possible to obtain maximum effectiveness at a few meters from the explosion point, unlike conventional fragments, e.g. balls, where maximum energy is obtained from where the fragments start, with the speed of the explosive-formed fragments typically decreasing in hyperbolic manner as a function of distance.

Furthermore, the inventors have found that the microprojectile or jet separated from the remainder of the metal wall 7 in the context of the present invention becomes unstable at a range of 2 m to 8 m from the explosion point, and breaks up into pieces after reaching its maximum effectiveness range. Consequently, the number of explosive-formed fragments multiplies rapidly along the trajectory thereof compared with the initial number, thus having the effect of maintaining effectiveness at a high level over a range of more than 5 meters.

Conversely, with traditional grenade fragments, the number of fragments per square meter decreases hyperbolically from the explosion point of the grenade.

The low mass of each ideal explosive-formed fragment, i.e. derived from the indentation 11 shown in FIG. 4, and the subdivision of said indentation which further reduces the mass of individual fragments, and the high speed of the fragments constitute three characteristics which cause the energy of individual explosive-formed fragments to drop ott considerably beyond about 8 meters.

Furthermore, the low mass of the explosive-formed fragments makes the grenade particularly light in weight. It therefore has the advantage of being capable of being thrown with great accuracy.

FIG. 6 shows a variant shape of indentation constituting a preferred embodiment of the present invention.

The indentation 11 shown in accompanying FIG. 6 is in the form of a quasi-spherical cap that is concave towards the inside of the ammunition.

More precisely, this indentation 11 is in the form of a quasi-spherical cap having a base width L of about 3 mm, a depth P of about 1.2 mm, and a wall thickness E of about 0.6 mm.

Such parameters correspond to the shape of a golf ball. In other words, such spherical caps, places side by side constitute an external wall which is quasi identical in aspect to that of a golf ball, as illustrated FIG. 7.

The invention claimed is:

1. An explosive round that produces fragments propelled by jetting effected, the round comprising firing head, an explosive charge, a fragment generating wall in direct contact with the explosive charge, which wall has a set of indentations in the form of caps extending towards the inside of the round and into the explosive charge, so that each indentation constitutes a shaped charge, each cap representing a surrounding base having a diameter comprised between 2.5 mm and 5.5 mm and a wall thickness comprised between 0.5 mm and 0.8 mm, the round further comprising wall of plastics material presenting an orifice, wherein the round has a plug complementary to the orifice, the plug having a surface designed to face the inside of the round, the surface having fixed thereon a portion of the fragment generating wall that is separable from the remainder of the fragment generating wall.

2. An explosive round according to claim 1, wherein the fragment generating wall is adjacent to the wall of plastics material.

3. An explosive round according to claim 1, wherein the caps are quasi-spherical or cones with rounded tips.

4. An explosive round according to claim 1, wherein the opening angle of the caps is 90° to 140°.

5. An explosive round according to claim 1, wherein the caps have an opening angle of 120°.

6. An explosive round according to claim 1, wherein the caps have a base width of about 3 mm.

7. An explosive round according to claim 1, wherein the caps have a wall thickness of about 0.5 mm to about 0.6 mm.

8. An explosive round according to claim 1, wherein the caps are conical in shape.

9. An explosive round according to claim 1, wherein the caps are of pyramid shape.

10. An explosive round according to claim 1, wherein the caps have rounded tips.

11. An explosive round according to claim 1, wherein the fragment-generating wall is made of copper.

12. An explosive round according to claim 1, wherein the explosive charge is essentially constituted by about 90 g of hexolite.

13. An explosive round according to claim 1, wherein the explosive charge is essentially constituted by about 90 g of TNT.

14. An explosive round according to claim 1, wherein the explosive charge is essentially constituted by a composite explosive having attenuated sensitivity to risk.

15. An explosive round according to claim 1, wherein the depth of the caps is about 1.2 mm.

* * * * *